United States Patent [19]

Boucher

[11] 3,945,149

[45] Mar. 23, 1976

[54] WINDOW CONSTRUCTION

[76] Inventor: Claude Boucher, 6900 Boulevard Gouin, West, Montreal, Quebec, Canada

[22] Filed: Aug. 27, 1974

[21] Appl. No.: 500,949

[52] U.S. Cl. ..... 49/121; 49/430; 49/446

[51] Int. Cl.[2] ..... E05F 17/00

[58] Field of Search ..... 49/121, 119, 406, 445, 49/446, 447, 448, 430

[56] References Cited

UNITED STATES PATENTS

| | | | |
|---|---|---|---|
| 2,941,237 | 6/1960 | Reese | 49/445 X |
| 3,065,507 | 11/1962 | Cloutier et al. | 49/119 X |
| 3,499,248 | 3/1970 | Baer | 49/446 X |
| 3,600,854 | 8/1971 | Dallaire et al. | 49/121 |

*Primary Examiner*—Philip C. Kannan

[57] ABSTRACT

A double window construction having inner and outer windows mounted within a frame. Each window has an upper and lower glass pane. Each pane is mounted for vertical movement in its own vertical guide channels within the frame. The panes are joined by flexible means in a counter-balanced manner. Means are attached to each glass pane for detachably connecting the panes to the flexible means.

3 Claims, 9 Drawing Figures

WINDOW CONSTRUCTION

This invention relates to windows and, more particularly, to improvements in windows of the type having two pairs of vertically slidable glass panes, with the lower pane of each pair connected to the upper pane of the other pair in counterbalanced fashion.

Windows of this type are known, as shown in Canadian Pat. No. 643,770, granted to J. T. Cloutier Inc. on June 26, 1962. While these windows are quite satisfactory for the purposes designed, they do have some disadvantages. There is a tendency for the glass panes to break, particularly at their corners, when installing or removing the glass panes from the frame. This is due to the manner of mounting the panes directly by their lower corners. Also, the support means for the panes, when mounted in the frame, are bulky and visible, thereby detracting from the appearance of the window. In addition, the support means for the panes and the guide means for a portion of the flexible means supporting the panes in a counterbalanced manner are relatively complex in construction and thus relatively expensive to manufacture.

It is therefore the purpose of the present invention to provide windows of the above type which are less prone to breaking, which are neater in appearance and which are more simple and less expensive in manufacture.

In one embodiment of the present invention, there is provided a double window construction which has a frame and inner and outer windows. Each window consists of an upper and lower glass pane. Each pane in each window is slidable in its own vertical extending guide means. First flexible means mounted in the frame connect, in counterbalanced manner, the lower pane of one window with the upper pane of the other window. Second flexible means mounted in the frame connect, in couterbalanced manner, the upper pane of the one window to the lower pane of the other window. Means are attached to each pane for detachably connecting it to its respective flexible means within the guide means.

Preferably, the means attached to each pane include rod members projecting laterally past the side edges of the pane. The rod members preferably are attached to sealing strips which in turn are attached to the bottom edge of each pane.

The invention will now be described in detail having reference to the accompanying drawings, in which:

FIGS. 4a and 4b are schematic views showing operation of the window;

Figure 1:
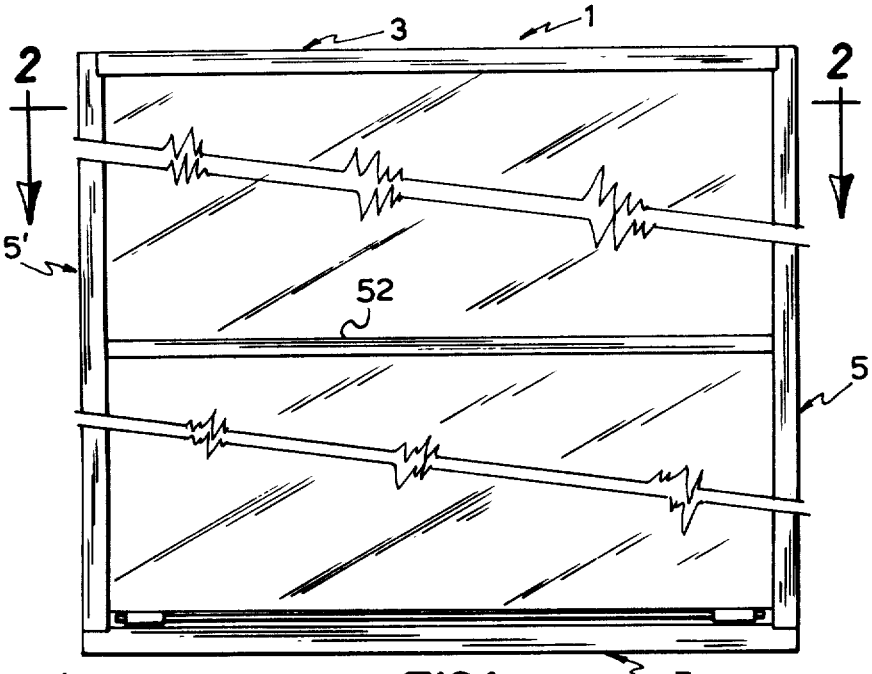
FIG. 1 is a front elevation view of a window construction according to the present invention.
Figure 2:
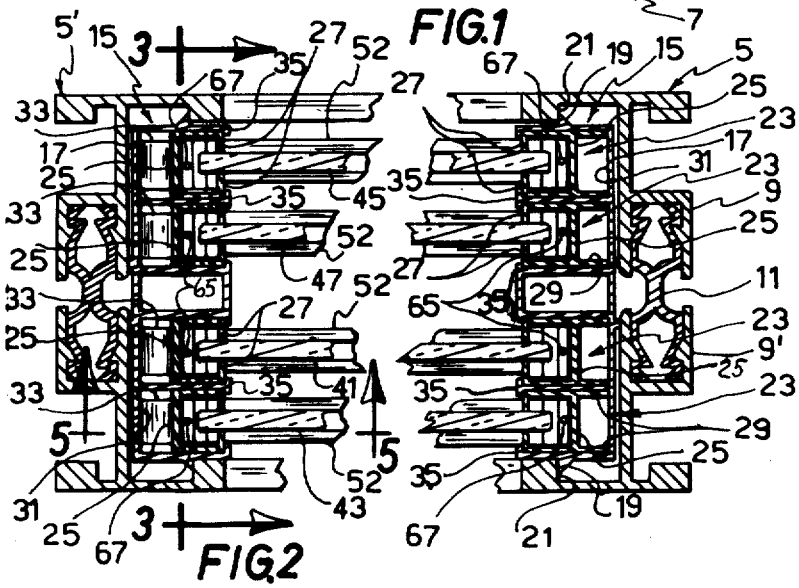
FIG. 2 is a cross-section view of the window construction taken along line 2—2 of FIG. 1.

The window construction includes a window frame 1, consisting of a lintel 3, jambs 5, 5′ and a sill 7. The lintel 3 and jambs 5, 5′ can each be made from two extruded members 9, 9′ joined together by a connector member 11, as shown in FIG. 2. The length of the connector member 11 can vary so as to vary the width of the lintel and jambs. The sill 7 can be made from one extruded member having a slightly sloping upper surface 13.

The jambs 5, 5′ each define a U-shaped recess 15. A window pane mounting member 17 is fixed in each recess 15. The mounting member 17 can have projections 19 at its ends, co-operating with shoulders 21 on the inside of the side walls of the recess 15, to hold it in position. The mounting member 17 has four vertical pockets 23 arranged in two pairs. Each pocket opens toward a corresponding pocket in the opposite jamb. An essentially U-shaped channel member 25 is mounted in each pocket 23 in each jamb. Each channel member 25 has a pair of inturned lips 27. The channel members 25 in one jamb 5 have depending legs 29 resting on end wall 31 of mounting member 17 to position them. The channel members 25 in the other jamb 5′ are each biased outwardly toward jamb 5 by a spring member 33 located between end wall 31 and each channel member. The channel members 25 in both jambs 5, 5′ are retained in the pockets 23 by shoulders 35 at the mouth of each pocket 23.

Figures 3, 4, 5, 6, 7, 8, 9:
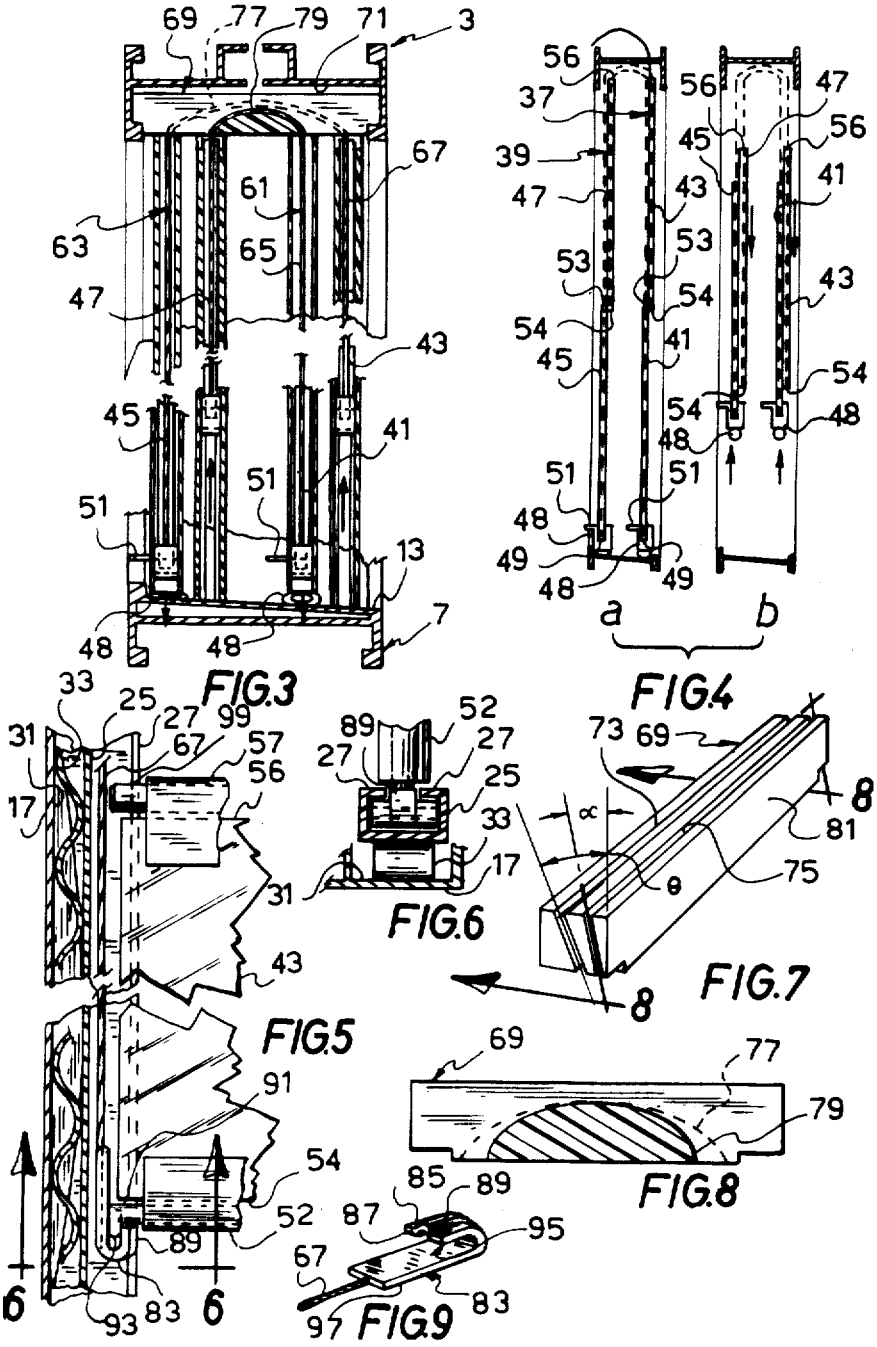
FIG. 3 is a cross-section view taken along line 3—3 of FIG. 2.
FIG. 5 is a cross-section view taken along line 5—5 of FIG. 2.
FIG. 6 is a cross-section view taken along line 6—6 of FIG. 5.
FIG. 7 is a schematic view of one of the transverse cable guide members.
FIG. 8 is a cross-section view of the guide member taken along line 8—8 of FIG. 7.
FIG. 9 is a schematic view of one of the hook-shaped pane support members.

Mounted in facing members 25 are window panes 41, 43, together forming the outer window 37, and window panes 45, 47, together forming the inner window 39, as shown in FIG. 4. The panes 41, 43, 45, 47 each are slidable in a vertical direction in their own guide means formed by respective channel members 25 in the pockets 23. The lower panes 41, 45 in each window have suitable sealing means 48 attached by a channel section, to the lower edge 49 of each pane. The sealing means 48 cooperate with the upper surface 13 of the sill 7, to close the bottom of each window 37, 39. Suitable handle means 51 are provided on each sealing means 48 for use in opening and closing the windows, as will be described. Suitable known sealing means 52, with a channel section, are also provided at the top edge 53 of each lower pane 41, 45 and the bottom edge 54 of each upper pane 43, 47 to seal the panes in each window 37, 39 together. The top edge 56 of upper panes 43, 47 also has a suitable seal 57 with a channel section.

Flexible means are provided for joining the panes of the windows together in a counterbalanced manner. First flexible means 61 join the lower pane 41 of the outer window 37 to the upper pane 47 of the inner window 39. Second flexible means 63 join the upper pane 43 of the outer window 37 to the lower pane 45 of the inner window 39. Flexible means 61 includes a pair of flexible members 65, such as steel cable, one on each side of the frame. Flexible means 63 also includes a similar pair of flexible members 67, one on each side of the frame. The cables 65, 67 run between their respective panes in the channel members 25 and cross transversely, in a curved path, from one channel member to the other at the top of the frame.

A cable guiding member 69 is provided at the top of the frame, at each end, for transversely guiding the cables 65, 67 in a curved path between the windows, as shown in FIG. 3. The guiding members 69 are mounted in the ends of a recess 71 in lintel 3. Each guiding member 69 has two longitudinal grooves 73, 75, as shown in FIG. 7. The bottom surfaces 77, 79 of both grooves are convex with the bottom surface 77 of groove 73 being longer than the bottom surface 79 of groove 75. The bottom surface 77 of groove 73 extends between the tops of the channel members 25 carrying panes 43, 45 and bottom surface 79 extends between the tops of channel members 25 carrying panes 41, 47. Preferably, the grooves 73, 75 are formed at different angles to the vertical so that their bottoms are closer together than their tops. Also, both grooves are preferably set at an angle to the vertical side face 81 of member 69 nearest the jambs. Thus, groove 75 extends at a slight angle $\alpha$ to the side face 81 with its bottom closely adjacent the bottom edge of side face 81. Groove 77 extends at a slightly larger angle $\beta$ to side face 81, but with its bottom also closely adjacent the bottom edge of side face 81. This groove arrangement, as shown in FIG. 7, minimizes weakening of the members 69 when providing the grooves.

The end of each cable 65, 67 is provided with a support member 83 integrally joined to the cable. The support members 83 are preferably hook shaped, as shown in FIGS. 5 and 9. The outer face 85 of the tip 87 of the hook members 83 preferably has a guide projection 89 which projection 89 has a width just slightly less than the width of the gap between the inturned lips 27 of channel members 25. The hook members 83 slide in the channel members 25 with guide projection 89 moving in the gap between lips 27.

Each window pane 41, 43, 45, 47 is detachably connected to the support members 83 on the cables by means attached to the panes. These means preferably comprise rods 91 which project laterally from the bottom corners of the panes, as shown in FIG. 5. Each rod 91 preferably is mounted in the sealing means which is attached to bottom edge of each pane. The rods 91 have a downwardly projecting head 93 which fits in the slot 95 formed between the tip 87 and shank 97 of hook 83. Thus, the panes each, in effect, sit on the hooks 83 attached to the cables 65,67. A guide rod 99 can also be provided at the top corner of each pane, projecting laterally from the ends of sealing members on the top edge of each pane through the gap between lips 27 into a respective channel member 25. Rod 99 serves to protect the upper corners of the panes.

In operation, the double window can be opened by first lifting inside lower pane 45. Through connection of pane 45 with pane 43 by cables 67 in a conterbalancing manner, the lifting of pane 45 results in pane 43 being lowered, as shown in FIG. 4. The lower outer pane 41 is then lifted, causing pane 47, through cables 65, to lower. The window panes are each guided for vertical movement by the lips 27 of channel members 25, as the side edges of the windows are fitted into the channel members.

The panes are each mounted in the frame by pushing one side edge of the pane into the channel members 25 in jamb 5'. The channel members 25 move inwardly against springs 33 a distance sufficient to permit the opposite edge of the pane to be inserted in members 25 in jamb 5. The springs 33 then maintain the pane in place. Each pane is detachably connected to the cable ends by placing the ends 93 of rods 91 into the hooks 83. The rods 91 are attached to the bottom corners of the panes via the sealing members. The use of the rods 91 minimizes the chances of breaking the corners of the panes and also, through attaching the rods to the sealing means, avoids having to drill attached holes in the glass panes, which could weaken the panes. The support hooks 83, carrying the panes, fit neatly within channel members 25 and thus provide the window with a neat appearance.

What I claim is:

1. A double window construction comprising a frame, an inner and an outer window, the frame having jamb portions with pairs of mutually facing longitudinal channel members secured therein, each channel member having a U-shaped cross-section and lips directed toward each other and forming a mouth on the open side of the channel member, each window including an upper and a lower sashless glass pane, each slidable in a vertical direction along the two channel members of a corresponding pair of channel members, an elongated sealing member secured lengthwise against the bottom edge of each sashless pane, rod sections fixedly mounted in the sealing members and extending lengthwise of the latter, and laterally projecting outwardly at the opposite side edges respectively of each sashless glass pane and into the corresponding two channel members respectively through the mouth thereof, a hook member vertically displaceable in each channel member and operatively supporting the corresponding rod section of the associated glass pane, a first pair of flexible elongated members supported in the frame and connected at opposite ends to the hook members of the lower pane of one window and the upper pane of the other window, and a second pair of flexible elongated members supported in the frame and connected at opposite ends to the hook members of the lower pane of the other window and the upper pane of the one window, whereby to support the panes in counterbalanced manner.

2. A double window construction as defined in claim 1, wherein each hook member is hook-shaped defining a shank portion and a tip portion with a slot interspacing the shank portion and the tip portion, the latter projects upwardly and defines an outer face facing toward the mouth of the corresponding channel member, a projection on the outer face guidably engaging the lips of the same channel member for guided displacement of the hook members lengthwise of the channel members, and each rod section includes a downwardly projecting head removably engageable in the slot of the corresponding hook member.

3. A double window construction as defined in claim 2, further including a guide block at the top of each window jamb overlying the channel members of the latter, and having a pair of grooves formed therein with an upwardly convex portion and laterally diverging from each other toward the latter.

* * * * *